US010689884B2

(12) United States Patent
Yuan

(10) Patent No.: US 10,689,884 B2
(45) Date of Patent: Jun. 23, 2020

(54) ACTUATOR ASSEMBLY FOR LOCKING DEVICE

(71) Applicant: Locway Technology Co., Ltd. (Dongguan Guangdong, CN), Dongguan (CN)

(72) Inventor: Mengxiao Yuan, Dongguan (CN)

(73) Assignee: Locway Technology Co., Ltd. (Dongguan Guangdong, CN), Dongguan (CN)

( * ) Notice: Subject to any disclaimer, the term of this patent is extended or adjusted under 35 U.S.C. 154(b) by 403 days.

(21) Appl. No.: 15/675,397

(22) Filed: Aug. 11, 2017

(65) Prior Publication Data

US 2018/0051483 A1 Feb. 22, 2018

(51) Int. Cl.

| | |
|---|---|
| ***E05B 47/02*** | (2006.01) |
| ***E05B 47/06*** | (2006.01) |
| *E05B 47/00* | (2006.01) |
| *E05B 63/00* | (2006.01) |
| *E05B 15/04* | (2006.01) |

(52) U.S. Cl.

CPC ..... *E05B 47/023* (2013.01); *E05B 47/0603* (2013.01); *E05B 15/04* (2013.01); *E05B 47/0012* (2013.01); *E05B 63/0013* (2013.01); *E05B 2015/0406* (2013.01); *E05B 2047/0031* (2013.01)

(58) Field of Classification Search

CPC ..... E05B 47/0012; E05B 2047/0023; E05B 2047/0031; E05B 2015/0406; E05B 47/0673; E05B 15/04; E05B 2015/0424; E05B 2047/0016; E05B 2047/0025; E05B 47/026; E05B 47/0692; Y10T 292/1021; Y10T 292/1082; Y10T 70/7113; Y10T 70/7051; Y10T 74/18312; Y10T 74/18576; Y10T 74/19702; E05C 19/028

See application file for complete search history.

(56) References Cited

U.S. PATENT DOCUMENTS

| | | | | |
|---|---|---|---|---|
| 3,321,228 | A * | 5/1967 | Sidle | E05C 19/028 292/74 |
| 10,316,548 | B2 * | 6/2019 | Yuan | E05B 47/0012 |
| 2008/0073917 | A1 * | 3/2008 | Ciavaglia | E05B 81/20 292/201 |
| 2008/0303290 | A1 * | 12/2008 | Yuan | E05B 47/0012 292/195 |
| 2011/0047874 | A1 * | 3/2011 | Lowder | E05B 65/1053 49/31 |

(Continued)

*Primary Examiner* — Mark A Williams
(74) *Attorney, Agent, or Firm* — Wang Law Firm, Inc.

(57) ABSTRACT

The invention relates to the technical field of locks and discloses an actuator assembly of a combination lock. The actuator assembly includes a fixed motor, a drive shaft fixed to the axis of the motor, a cylindrical spring sheathed on the drive shaft and displaceable axially, a pin installed onto the drive shaft which may screw within two adjacent loops of the cylindrical spring, and a casing installed coaxially with the motor. The casing includes a cavity for accommodating the cylindrical spring, and a second sliding groove formed on the casing, and both ends of the cylindrical spring have a retaining ring extended outwardly from the outer periphery of the cylindrical spring and the retaining ring disposed at the second sliding groove for preventing the rotation of the cylindrical spring.

7 Claims, 7 Drawing Sheets

(56) References Cited

U.S. PATENT DOCUMENTS

| | | | | |
|---|---|---|---|---|
| 2011/0215597 | A1* | 9/2011 | Weum | E05B 47/00 292/144 |
| 2012/0198897 | A1* | 8/2012 | Lui | E05B 47/0012 70/280 |
| 2013/0033045 | A1* | 2/2013 | Worm | E05B 65/0075 292/5 |
| 2013/0043751 | A1* | 2/2013 | Yuan | E05B 47/026 310/80 |
| 2013/0305792 | A1* | 11/2013 | Lien | E05B 47/0012 70/278.7 |
| 2016/0060904 | A1* | 3/2016 | Dore Vasudevan | E05B 47/0673 292/144 |

* cited by examiner

ACTUATOR ASSEMBLY FOR LOCKING DEVICE

FIELD OF INVENTION

The present invention relates to the field of locks, in particular to an actuator assembly of a combination lock.

BACKGROUND OF INVENTION

Description of the Related Art

The present invention improves over the prior art based on the technical solution as disclosed in P.R.C. Pat. No. CN201110244325.0.

A conventional combination lock generally adopts a lock mechanism driven by a micro motor. One of the technical solutions adopts a coil spring sheathed on a rotating shaft and a pin fixed to the rotating shaft, and the rotation of the motor is converted into a linear movement between the spring and the pin to push or pull a blocking member to control and receive a lock bolt of the lock.

Due to cost reasons, the combination lock generally uses a micro DC motor. However, the micro DC motor has the disadvantages of a wide dispersion of parameters in its manufacturing process, a change of battery voltage, and a large difference of its rotation speed, and it is very difficult to control the stroke of the pin with respect to the coil spring even when a reducer gear set is used and the power-on time is controlled. Most of the time, the pin may slip or jam when it moves to a distal end of the spring (for the last turn of the spring) and if the motor is still not powered off. As a result, a relatively larger friction may be produced or the spring may be jittered and twisted easily.

When the pin moves along the spiral of the spring, the spring is compressed by the pressure of the pin to produce a relatively larger friction, and the friction further generates a force to rotate the spring axially and causes an axial rotation and a radial jitter of the spring easily, and the spring cannot be displaced stably in the axial direction. These results not just wear out or damage the spring and slider only, but also cause the pin being locked-rotor into the spiral track of the spring. In addition, the friction produced between the pin and the spring may wear out or damage the pin and the spring.

As disclosed in P.R.C. Pat. No. CN201110244325.0, the jitter and jumping of the spring are controlled by installing a third winding of a spring to absorb and buffer the vibration and impact produced by the pin to the spring when the motor is starting and turning, so as to prevent the spring from twisting or jittering. However, P.R.C. Pat. No. CN201110244325.0 has not disclosed any technical solution to overcome the problem of wearing out the pin and the spring.

In summation, the problem related to the jitter and jumping of the spring may be overcome by the aforementioned or other technical solutions, but the problem of wearing out the pin and the spring still remains unsolved. For the interaction between the pin and the coil spring, the rotation of the motor is converted into a linear movement between the coil spring and the pin to push or pull a blocking member in order to control and receive a lock bolt of the lock. Obviously, the present invention can improve the performance of the actuator assembly for locks.

SUMMARY OF THE INVENTION

Therefore, it is a primary objective of the present invention to provide an actuator assembly of a lock with simple structure and high safety and reliability.

To achieve the aforementioned and other objectives, the present invention provides an actuator assembly for a locking device, comprising: a fixed motor, a drive shaft fixed to the axis of the motor, a cylindrical spring sheathed on the drive shaft and displaceable axially, a pin installed onto the drive shaft and screwed within two adjacent loops of the cylindrical spring, and a casing installed coaxially with the motor, characterized in that casing comprises a cavity for accommodating the cylindrical spring, and a second sliding groove formed on casing, and both ends of the cylindrical spring have a retaining ring extended outwardly from the outer periphery of the cylindrical spring and disposed at the second sliding groove for preventing the rotation of the cylindrical spring.

Preferably, the second sliding groove includes two symmetrical bevels, and the retaining ring includes two rings formed by two free ends of the cylindrical spring respectively and extended outwardly from both ends of the cylindrical spring, and the axis of the ring is perpendicular to the axis of the cylindrical spring, and the bevel and the ring surface of the retaining ring abut against one another.

Preferably, the second sliding groove includes two symmetrical bevels, and the retaining ring includes a neck formed by two free ends of the cylindrical spring, and a ring coupled to the neck, and the two rings are extended outwardly from both ends of the cylindrical spring, and the axis of the ring is parallel to the axis of the cylindrical spring, and the bevel and the neck of the retaining ring abut against one another.

Wherein, casing includes a first-half casing and a second-half casing installed symmetrically with respect to the axis of casing, and after the first-half casing and the second-half casing are combined to form the cavity, the cavity comprises: a cylindrical cavity and two circular cone frustum shaped cavities symmetrically formed on both sides of the cylindrical cavity, and the cylindrical cavity has a diameter greater than the diameter of the axial and radial rotation of the pin around the cylindrical spring, and the circular cone frustum shaped cavity has a small diameter greater than the outer diameter of the cylindrical spring, and the circular cone frustum shaped cavity has a large diameter equal to the diameter of the cylindrical cavity.

Wherein, the distal end of the first-half casing or the distal end of the second-half casing has a buckle, and the distal end of the second-half casing or the distal end of the first-half casing has a hook matched with the buckle, and both first-half casing and second-half casing have a rivet hole for pivotally coupling the first-half casing and the second-half casing.

Wherein, the first-half casing and the second-half casing have a recess symmetrically and separately formed on a joint surface of the first-half casing and the second-half casing, and the recess includes a bevel, and after the first-half casing and the second-half casing are combined, the recess forms the second sliding groove.

Preferably, the two bevels of the second sliding groove have an included angle of 35 degrees to 45 degrees.

Preferably, the actuator assembly for a locking device further comprises a bearing shell matched with the pin, and the drive shaft having a bearing shell mounting hole formed thereon and matched with the bearing shell.

Preferably, the bearing shell is in a ring shape, and the pin includes two pin nails configured head to head with each other, and each pin nail has a head with a diameter greater than the inner hole of the bearing shell.

Preferably, the actuator assembly for a locking device further comprises a positioning block disposed between the heads of the two pin nails.

The present invention has the following advantages:

1. The structure of two retaining rings and the second sliding groove of casing is adopted, and the retaining ring is contacted with a bevel or arc surface of the second sliding groove, and the force is uniformly received, so as to effectively reduce or prevent the jitter or jumping of the spring during the process of rotating the pin along the cylindrical spring.

2. The two half casings are combined to form the cavity structure. Compared with the conventional frame, the invention changes the plan that limits the axial jitter of the cylindrical spring into a uniform arc surface disposed along the circumference of the cylindrical spring, so as to improve the ability of limiting the radial jittering of the cylindrical spring and the operating reliability of the actuator assembly. In addition, the buckles installed to the two half casings and the rivets can overcome the problems of fixing the half casings securely and positioning them accurately.

3. The invention uses the bearing shell made of an oily material and installed on the drive shaft and operated with the pin to change the sliding friction into the rolling friction, so as to significantly reduce the friction between the pin and the cylindrical spring and effectively overcome the wearing problem of the pin and the cylindrical spring.

4. The present invention uses a smaller amount of components and has the features of simple structure, to facilitate manufacturing and installation.

DESCRIPTION OF THE PREFERRED EMBODIMENTS

The above and other objects, features and advantages of this disclosure will become apparent from the following detailed description taken with the accompanying drawings.

Figure 1:
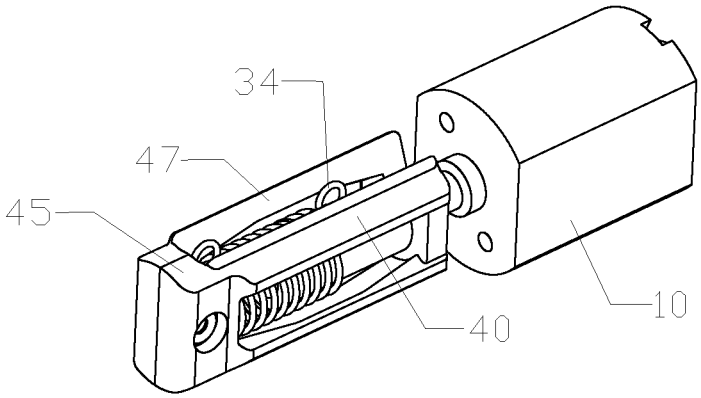
FIG. 1 is a perspective view of a first preferred embodiment of the present invention.
Figure 2:
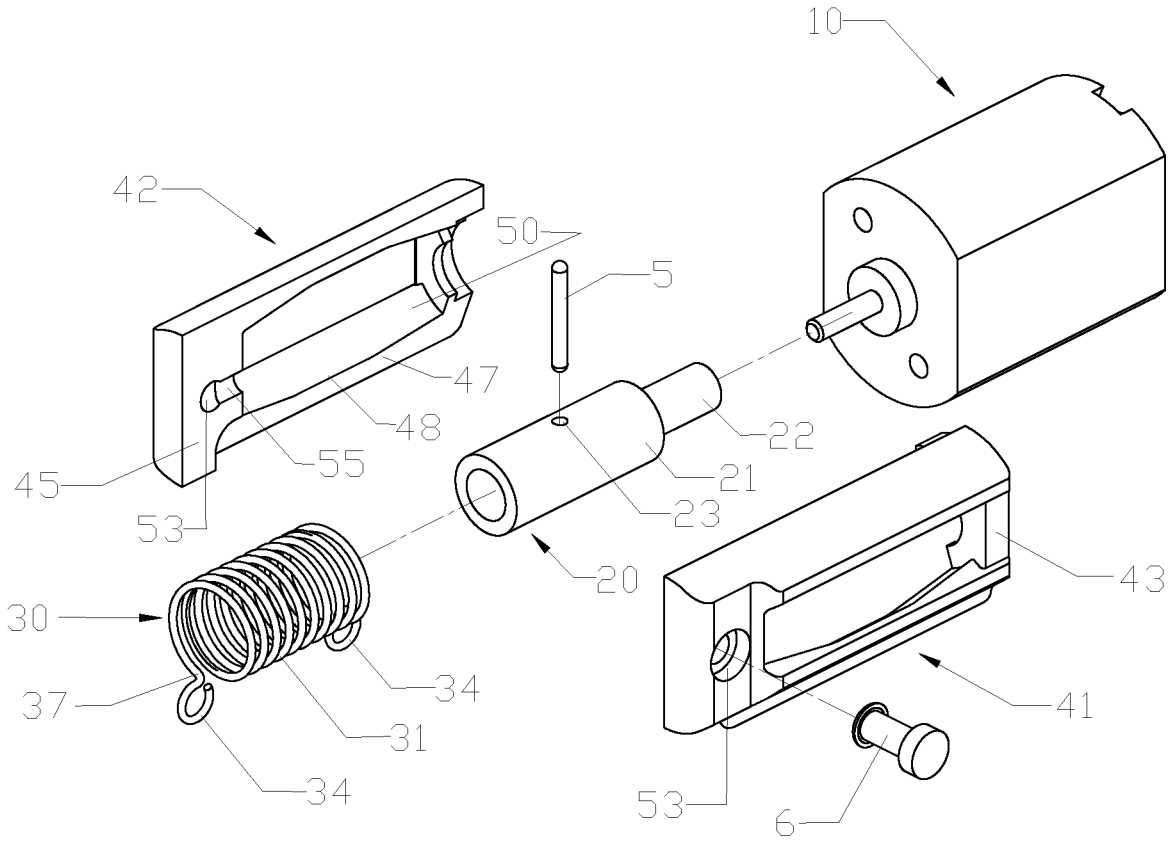
FIG. 2 is an exploded view of the first preferred embodiment of the present invention.
Figure 3:
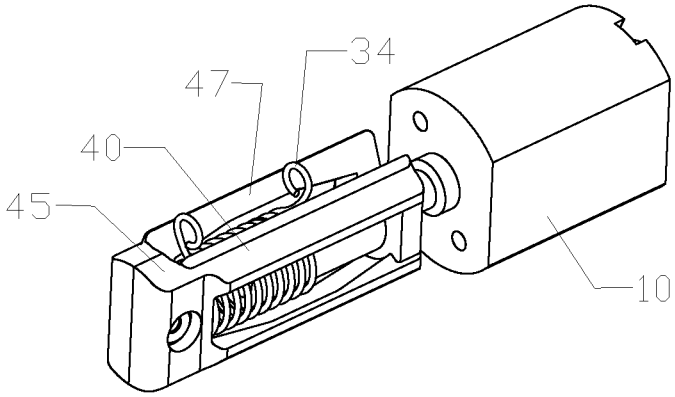
FIG. 3 is a perspective view of a second preferred embodiment of the present invention.
Figure 4:
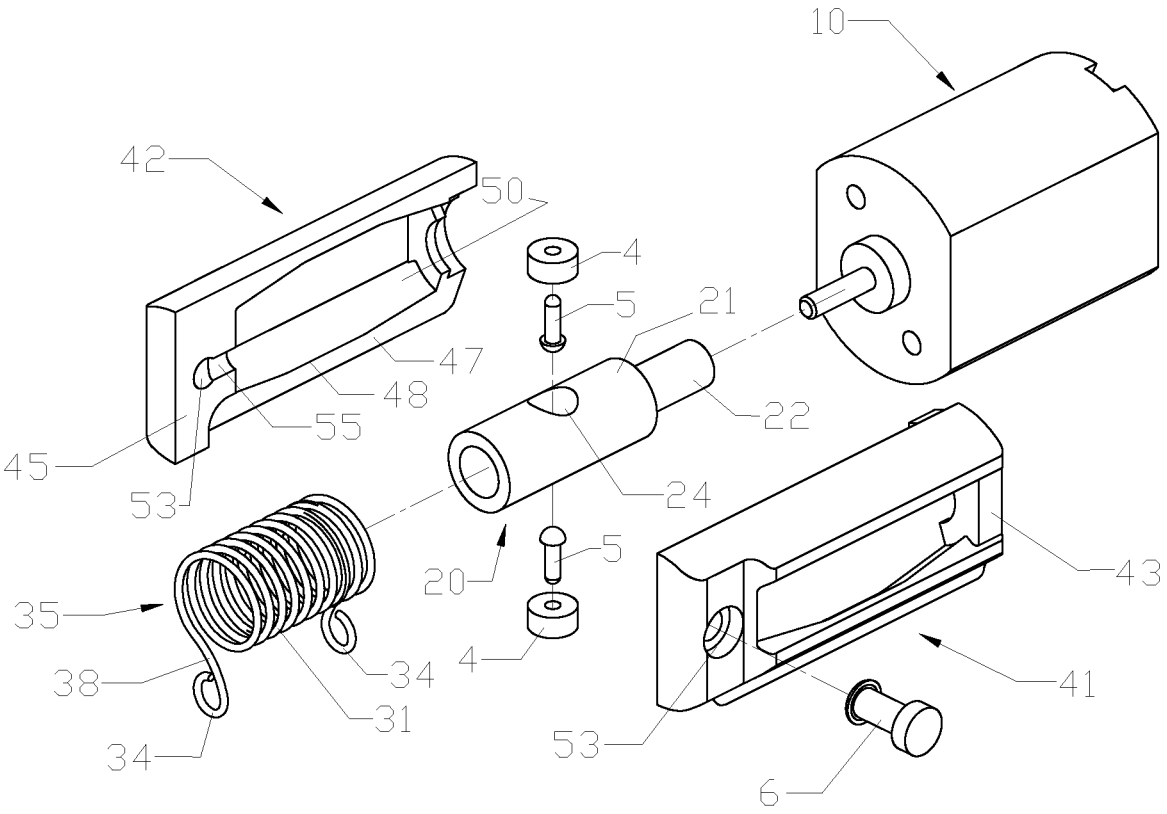
FIG. 4 is an exploded view of the second preferred embodiment of the present invention.

With reference to FIGS. 1 and 2 for the structure of the first preferred embodiment of the present invention and FIGS. 3 and 4 for the structure of the second preferred embodiment of the present invention, both preferred embodiments comprise a motor 10, a drive shaft 20, and a casing 40 which are the same in both embodiments, and the shape and size of the whole actuator assembly are the same in both embodiments, except that the retaining rings of a coil spring 30 and a coil spring 35 are different and whether or not a bearing shell matched with a pin 5 is adopted. Both of the coil spring 30 and coil spring 35 include a cylindrical spring 31 and two retaining ring 34 symmetrically installed at both ends of the cylindrical spring 31, wherein the cylindrical spring 31 is the same in both embodiments, and the shape and the size of the retaining ring 34 are the same in both embodiments, and the differences between the coil spring 30 and the coil spring 35 simply reside on that their extending length and direction are different, so that some of the working statuses are different, and such differences and the structure of the bearing shell will be described in details below.

In the first and second preferred embodiments of the present invention, the motor 10 is a conventional micro DC motor, and the drive shaft 20 is made of metal or a composite material, and the drive shaft 20 is sheathed on and fixed to the shaft of the motor by interference kit, and the outer cylindrical surface 21 of the drive shaft 20 is slidably matched with the inner periphery of the cylindrical spring 31, and a mounting hole 23 is perpendicularly formed at the middle of the outer cylindrical surface 21 of the drive shaft 20. After the pin 5 is installed into the mounting hole, both ends exceed the outer periphery of the cylindrical spring 31, and the diameter of the pin 5 is slightly smaller than the spring pitch of the cylindrical spring 31 in the free status, so that the pin 5 can be rotated within two adjacent loops of the spring. After the drive shaft 20, the cylindrical spring 31, and pin 5 are assembled together, the drive shaft 20, cylindrical spring 31 and cylindrical surface 21 will be situated on the same axis.

Figure 5:
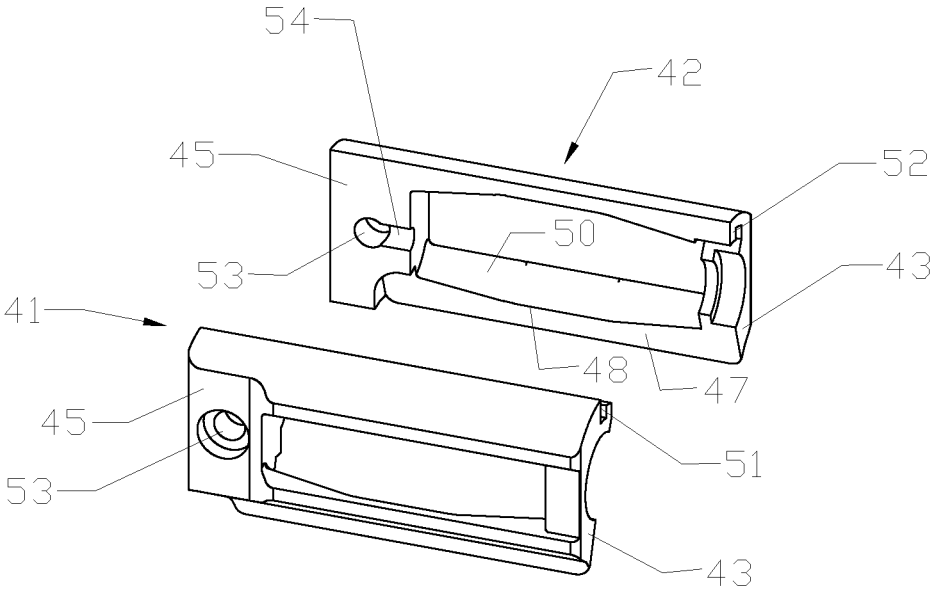
FIG. 5 is a perspective view of a casing of the present invention.
Figure 6:
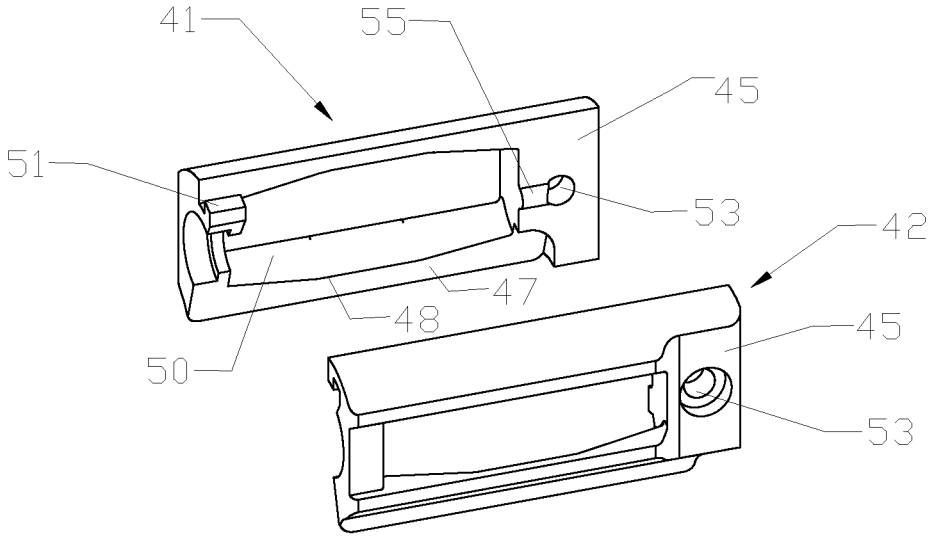
FIG. 6 is another perspective view of a casing of the present invention.

In FIGS. 1 and 5-6, the said casing 40 comprises a first-half casing 41 and a second-half casing 42 installed symmetrically along the axis of casing 40. After the first-half casing 41 and the second-half casing 42 are combined, the cavity 50 is formed, and the cavity comprises: a cylindrical cavity disposed at the middle of the cavity, and two circular cone frustum shaped cavities symmetrically formed on both sides of the cylindrical cavity, and the cylindrical cavity has a diameter greater than the diameter of the axial and radial rotation of the pin around the cylindrical spring, and the circular cone frustum shaped cavity has a small diameter greater than the outer diameter of the cylindrical spring 31, and the circular cone frustum shaped cavity has a large diameter equal to the diameter of the cylindrical cavity.

Specifically, the casing 40 is comprised of two symmetrical casings, respectively: the first-half casing 41 and the second-half casing 42, and the first-half casing 41 and the second-half casing 42 may be in form of a cylindrical half shell or a rectangular half shell, each including half of a distal end of the casing 43, half of the head of casing 45, and half of the cavity 50. In the whole cavity 50, the middle of the cavity 50 has a diameter greater than the rotating diameter of the pin 5, and both sides of the cylindrical cavity gradually cross from the cylindrical cavity towards both ends to the circular cone frustum shaped cavity, and its minimum diameter is substantially equal to but slightly greater than the external diameter of the cylindrical spring 31. The distal ends of the first-half casing 41 and second-half casing 42 have a semicircular hole with a diameter slightly greater than the diameter of the drive shaft neck 22. After the first-half casing 41 and the second-half casing 42 are combined to form the drive shaft neck 22, they can pass through the round hole, and the axial displacement of the cylindrical spring 31 is limited in a range between two internal distal surfaces of the cavity 50.

Figure 7:
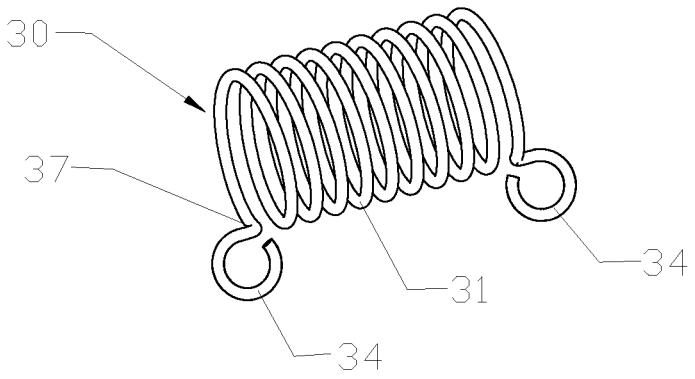
FIG. 7 is a perspective view of a cylindrical spring in accordance with the first preferred embodiment of the present invention.

In FIGS. 2 and 7, the retaining rings 34 are two symmetrical rings formed by the two free ends of the cylindrical spring 31, and the retaining ring is not just extended out from the outer periphery of the cylindrical spring 31 only, but also extended from both ends of the cylindrical spring 31. The axis of the ring is perpendicular to the axis of the cylindrical spring 31. After the assembling process, the retaining ring 34 is disposed in the second sliding groove 48 of the casing 40, and the contact surface between the retaining ring 34 and the second sliding groove 48 constitutes two bevels 47. When the cylindrical spring 31 is turned by the friction of the pin 5, the corresponding bevel 47 abuts the retaining ring 34 to prevent the cylindrical spring 31 from rotating (When the cylindrical spring 31 is turned by the friction of the pin 5 in the opposite direction, the other bevel abuts the retaining ring).

With reference to FIGS. 5 and 6 for the structure of the first-half casing 41 and the second-half casing 42, a recess is formed on the corresponding joint surface of each of the first-half casing 41 and second-half casing 42, and the smooth bevel 47 is disposed in the recess. After the first-half casing 41 and the second-half casing 42 are combined to form a second sliding groove 48 of the symmetrical bevel. When the cylindrical spring 31 is turned, the retaining ring 34 can be flatly contacted with the bevel 47. Testing data show that the smallest jittering of the cylindrical spring 31 occurs when the included angle between the two bevels 47 of the second sliding groove 48 falls within the range from 35 degrees to 45 degrees.

After the cylindrical spring 31 is installed in the cavity 50, not just the range of its axial displacement is limited only, but both of its radial displacement and jittering are also limited effectively. Although the drive shaft 20 has the effect of limiting the radial displacement of the cylindrical spring 31, as the cylindrical spring 31 has to move with respect to the drive shaft 20 between the locked and unlocked statuses, the interval between the cylindrical spring 31 and the drive shaft 20 should not be too small, otherwise the axial displacement may be hindered during the process of compressing or releasing the cylindrical spring 31 by friction. Therefore, the shape of the cylindrical spring 31 matched with the structure of the cylindrical casing cavity 50 may effectively limit the jittering or jumping of the cylindrical spring 31 to improve the operating reliability of the actuator assembly effectively. The structure of the first-half casing 41 and the second-half casing 42 can increases the contact area between the cavity 50 and the external periphery of the cylindrical spring 31, to significantly enhance the limitation brought by the casing 40 against the cylindrical spring 31. In addition, the structure with such components can be manufactured conveniently and easily.

With reference to FIGS. 5 and 6 together with FIGS. 1 and 2, a buckle 51 is installed at a distal end of the first-half casing 41 or a distal end of the second-half casing 42, and a hook 52 matched with the buckle 51 is installed at a distal end of the second-half casing 42 or a distal end of the first-half casing 41, and both first-half casing 41 and second-half casing 42 have a rivet hole for pivotally coupling the first-half casing 41 and the second-half casing 42. Specifically, the first-half casing 41 or the second-half casing 42 is fixed by using the buckle 51 and the hook 52 installed at the distal ends of the first-half casing 41 and the second-half casing 42 respectively. In other words, a half casing has a buckle 51, and the other half casing has a hook 52. In FIG. 3, the buckle 51 and the hook 52 are a recession and a protrusion latched with each other. In other words, the protrusion on the first-half casing 41 corresponds to the recession on the second-half casing 42, or the recession of the first-half casing 41 corresponds to the protrusion of the second-half casing 42. In addition, the head of casing 45 has a rivet hole 53 formed thereon for fixing the first-half casing 41 or the second-half casing 42 by a rivet 6. To position alternately, a semicircular locating slot 54 is formed adjacent to the rivet hole 53 of the head of the half casing, and the head of the other half casing is configured to be corresponsive to a positioning bar 55 matched with the locating slot 54.

Figure 8:
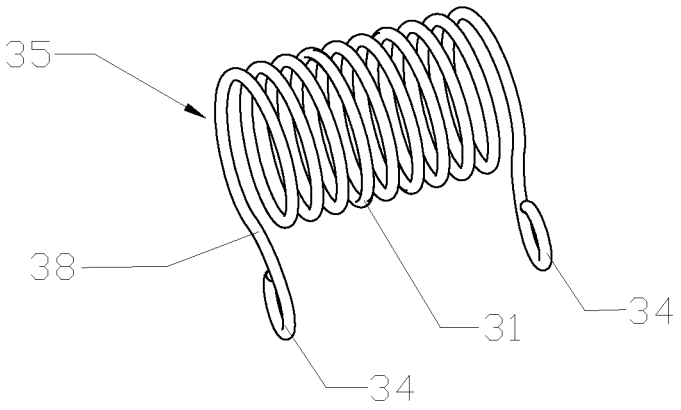
FIG. 8 is a perspective view of a cylindrical spring in accordance with the second preferred embodiment of the present invention.

FIG. 7 shows the structure of the coil spring 30 of the first preferred embodiment, and FIG. 8 shows the structure of the coil spring 35 of the second preferred embodiment, and the structures of the two coil springs are substantially the same except that the ways of extending the retaining ring 34 are different. In the coil spring 30, the axis of the retaining ring 34 is perpendicular to the axis of the cylindrical spring 31, and a bent section 37 is formed between the retaining ring 34 and an end ring of the cylindrical spring 31. When the cylindrical spring 31 is rotated altogether, the ring surface of the two retaining rings 34 abuts against one of the bevels 47 of the second sliding groove 48 to block the cylindrical spring 31 from rotating altogether. In addition, when the pin 5 is rotated to the bent portion 37 and if the motor is still not disconnected, the pin 5 will be blocked by the bent portion 37 and will stop rotating, so that the actuator assembly is locked-rotor.

In the coil spring 35, the said retaining ring 34 includes a neck 38 formed by two free ends of the cylindrical spring 31 and a ring coupled to the neck 38, and the two rings are extended outwardly from both sides of the cylindrical spring 31 respectively, and the axis of the ring is parallel to the axis of the cylindrical spring 31, and the bevel 47 and the neck 38 of the retaining ring 34 abut against each other. Specifically, an extended section (i.e. the neck 38 of the retaining ring) is formed between the ring of the retaining ring 34 and the end ring of the cylindrical spring 31. In other words, the neck 38 of the retaining ring is extended smoothly from the end ring of the cylindrical spring 31, and the inclined angle is equal to that of the bevel 47 of the second sliding groove 48. When the cylindrical spring 31 is rotated altogether, the necks 38 of the two retaining ring abut one of the bevels 47 of the second sliding groove 48 to stop the rotation of the cylindrical spring 31. Since the neck 38 crosses the cylindrical spring and the retaining ring smoothly, the pin 5 will slip when the pin 5 is rotated to the position of the neck 38 of the retaining ring 34, if the motor 10 is still not powered off, as no thread is provided for rotating the pin and no bent portion is provided for stopping the pin 5. It is noteworthy that the two retaining rings 34 are wound in different directions, but their shape and size are the same, and their positions are symmetrical, and their effects are the same, so that they are said to be symmetrical.

In FIGS. 3 and 4, the actuator assembly for a locking device of the invention further comprises a bearing shell 4 matched with the pin 5, and the drive shaft has the bearing shell mounting hole 24 formed thereon and matched with the bearing shell 4. Specifically, the bearing shell 4 is in a ring shape and made of a wear-resisting oily material, and an inner hole of the bearing shell and the pin 5 are slidably matched with each other, and the external periphery and the bearing shell mounting hole 24 are configured to be interference fit. The pin 5 includes two identical pin nails, and the pin nail has a diameter greater than an inner hole of the bearing shell 4 and smaller than the head of the bearing shell mounting hole 24. In an assembling process, the head of the two pin nails is oppositely installed into the bearing shell mounting hole 24, and then the bearing shell 4 is fixed into the bearing shell mounting hole 24 to form a whole pin 5, and a portion of the whole pin 5 extended from the rotating shaft has a diameter and a height identical to those of the pin 5 of the first preferred embodiment. To prevent the heads of the two pins from rubbing each other, a positioning block (not shown in the figures) may be installed between the heads of the two pin nails and configured to be interference fit with the bearing shell mounting hole 24.

The benefit of installing the bearing shell 4 resides on that when the pin 5 is rotated between two adjacent loops of the spring, the pin 5 may rotate with the drive shaft 20 or rotate by itself. Therefore, the original sliding friction produced between the pin 5 and the spring is changed to a rolling friction to effectively reduce the wearing of the pin and the spring. Particularly, when the pin 5 rotates idly or slips at the position of the neck 38 of the retaining ring, the friction is the largest at that moment, and the use of the bearing shell can significantly reduce the friction when the pin 5 slips. It is noteworthy that the aforementioned technical solution of the bearing shell 4 may be used in the first preferred embodiment of the present invention. Although the pin 5 is blocked by the bent portion 37 and can no longer be rotated at the position of the retaining ring in the first preferred embodiment, only a small friction is produced by rotating the pin 5 into the spring, so that the structure of the bearing shell may be omitted to simplify the structure. After the structure of the bearing shell is used, the friction produced by rotating the pin 5 into two adjacent loops of the spring can be further reduced.

The operating process of the two preferred embodiments of the present invention will be described together with FIGS. 9 and 10 as follows.

Figure 9:
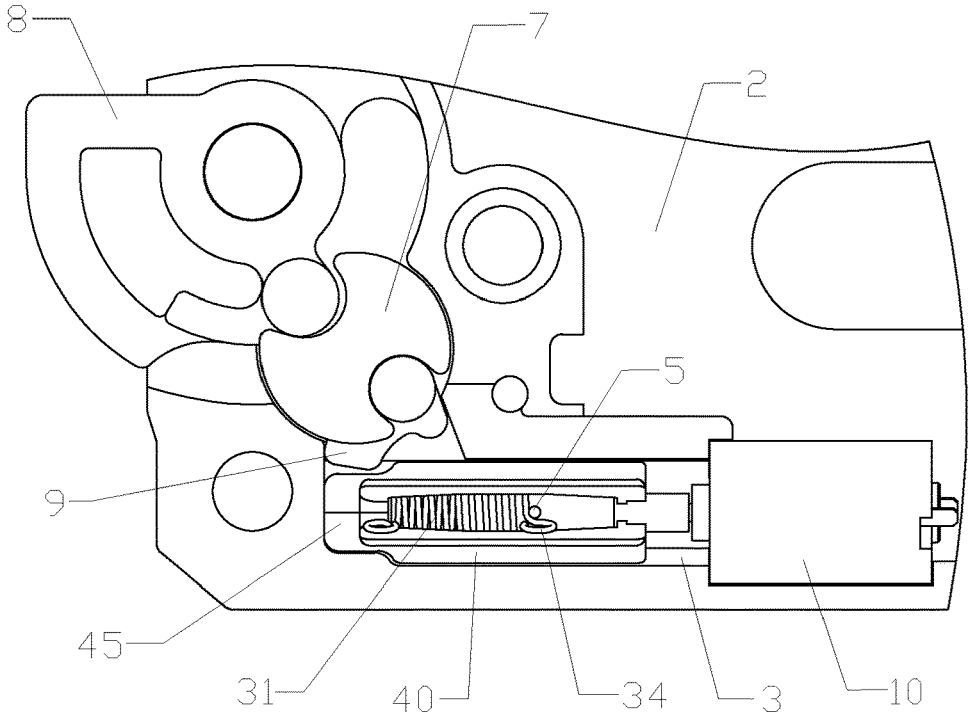
FIG. 9 is a schematic view of a lock housing situated at a locked position in accordance with the first preferred embodiment of the present invention.

In FIG. 9, the actuator assembly of the present invention is installed in a swing bolt lock, and casing 40 is installed into the first sliding groove 3 in the lock housing 2. In FIG. 9, casing 40 is situated at an extended position. At such position, the head of casing 45 occupies the space at the left end of the first sliding groove. To unlock the lock, an external force is applied to push the lock bolt 8 to turn and be received into the lock housing 2, and a swinging post 7 matched with the lock bolt is rotated at the same time to drive a cam dog 9 to enter into the space at the right end of the first sliding groove. Without the authorization for unlock, the head of casing 45 blocks the cam dog 9, so that the external force cannot push the lock bolt 8 to rotate or be received into the lock housing 2, so that the lock bolt 8 will be locked. In FIG. 9, when casing 40 is situated at the extended position, the pin 5 is situated at the right end of the cylindrical spring 31 (or the cylindrical spring is situated on the left side of the pin) and abutted against the bent portion of the right retaining ring 34, and the two retaining rings abut against the bevel 47 under the second sliding groove 48 of casing.

Figure 10:
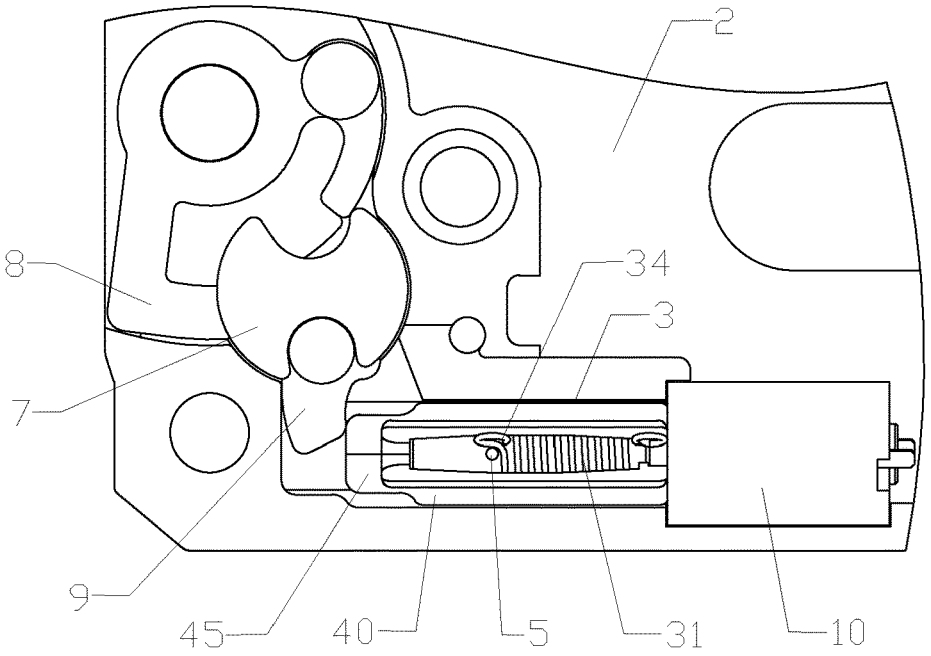
FIG. 10 is a schematic view of a lock housing situated at an unlocked position in accordance with the first preferred embodiment of the present invention.

In FIG. 10, after the authorization for unlock is received (in other words, the control unit of the lock has receive the correct password for unlock, the motor 10 is powered, and the motor 10 starts rotating clockwise (viewing from the right side of the motor)), and the pin 5 starts rotating clockwise towards the right end of the cylindrical spring 31, while the cylindrical spring 31 is moving towards the right end of the casing 40. After the right end of the cylindrical spring 31 touches the cavity 50 of casing, casing 40 is pushed by the cylindrical spring 31 to move towards the right until the head of casing 45 is completely separated from the originally occupied space at the left end of the first sliding groove 3. Now, the external force pushes the lock bolt 8 to rotate counterclockwise while driving the swinging post 7 to rotate clockwise, and the swinging post drives the cam dog 9 to rotate counterclockwise, so that the cam dog enters into the first sliding groove 3, while the lock bolt 8 returns into the lock housing 2, and the lock is unlocked. At such position, the pin 5 is situated at the left end of the cylindrical spring 31 (or the cylindrical spring is situated on the right side of the pin), and the bent portion 37 of the left retaining ring 34 stops the pin 5 from rotating, and the retaining ring abuts against the bevel 47 on the second sliding groove 48 of casing 40.

After the unlocking process ends, the external force is released, and the lock bolt returns to its locked status by the resilience of the spring. In the meantime, the swinging post 7 is driven to rotate counterclockwise, so as to drive the cam dog 9 to rotate clockwise from the first sliding groove 3 to the outside. Now, the motor 10 is powered on and rotated counterclockwise, and the pin 5 is rotated into the cylindrical spring from the left end of the cylindrical spring 31 to push the cylindrical spring to move towards the left end of casing 40, so as to push casing to move towards the left until the head of casing 45 occupies the space of the left end of the first sliding groove 3 of the lock housing and returns the lock bolt to its locked status as shown in FIG. 9.

The operating process of the second preferred embodiment is substantially the same as the operating process of the first preferred embodiment except that: in the first preferred embodiment, when the pin 5 is rotated to the position of the retaining ring 34, the pin 5 will be blocked by the bent portion of the retaining ring and cannot be rotated further, so that the motor 10 is situated in locked-rotor condition; while in the second preferred embodiment, when the pin 5 is rotated to the position of the retaining ring 34, the pin 5 slips at the position of retaining ring neck 39 between the retaining ring and the cylindrical spring, so that the motor 10 will not be locked-rotor.

Since the selected micro motor can be situated in locked-rotor condition for a short time without affecting the performance of the motor or damaging the motor, the technical solution of using these two types of spring structures is feasible. Regardless of which of the two structures is adopted, it is necessary to power off the motor after the locking or unlocking process is completed. In general, the locking device with electronic control comes with a position switch to detect any positional change of a lock bolt, a slider, or any other component linked with the lock bolt, and transmit a signal to the control unit of the locking device in order to timely stop the operation of the motor.

While the invention has been described by means of specific embodiments, numerous modifications and variations could be made thereto by those skilled in the art without departing from the scope and spirit of the invention set forth in the claims.

What is claimed is:

1. An actuator assembly for a locking device, the actuator assembly comprising:

a motor;

a drive shaft fixed to the axis of the motor, the drive shaft having a bearing shell mounting hole;

a cylindrical spring sheathed on the drive shaft and the cylindrical spring being displaceable axially;

a pin installed onto the drive shaft and rotates within two adjacent loops of the cylindrical spring;

a bearing shell mounted on the pin and fitted into the bearing shell mounting hole; and a casing installed coaxially with the motor, wherein the casing comprises a first-half casing and a second-half casing installed symmetrically with respect to an axis of the casing, and the said first-half casing and the second-half casing are attached through a rivet to form a cavity for accommodating the cylindrical spring, and a second sliding groove formed on the casing, and each end of the cylindrical spring have a retaining ring extended outwardly from an outer periphery of the cylindrical spring and the retaining ring disposed at the second sliding groove for preventing the rotation of the cylindrical spring, and the cavity comprises a cylindrical cavity and two circular cone frustum shaped cavities symmetrically formed on both sides of the cylindrical cavity, and the cylindrical cavity has a radius greater than a radius rotation of the pin around an axis of the cylindrical spring, and the circular cone frustum shaped cavities have a small diameter greater than an outer diameter of the cylindrical spring, and the circular cone frustum shaped cavities have a large diameter equal to a diameter of the cylindrical cavity.

2. The actuator assembly for a locking device according to claim 1, wherein the second sliding groove includes two symmetrical bevels, and the retaining ring includes two rings which are formed by two free ends of the cylindrical spring respectively and which are extended outwardly from both ends of the cylindrical spring, and the axis of the ring is perpendicular to the axis of the cylindrical spring, and the bevel and the ring surface of the retaining ring abut against one another.

3. The actuator assembly for a locking device according to claim 1, wherein the second sliding groove includes two symmetrical bevels, and the retaining ring includes a ring coupled to the neck which is formed by two free ends of the cylindrical spring, and two rings are extended outwardly from both ends of the cylindrical spring, and the axis of the ring is parallel to the axis of the cylindrical spring, and the bevel and the neck of the retaining ring abut against one another.

4. The actuator assembly for a locking device according to claim 1, wherein the distal end of the first-half casing or the distal end of the second-half casing has a buckle, and the distal end of the second-half casing or the distal end of the first-half casing has a hook matched with the buckle, and both first-half casing and second-half casing have a rivet hole for pivotally coupling the first-half casing and the second-half casing.

5. The actuator assembly for a locking device according to claim 1, wherein the first-half casing and the second-half casing have a recess symmetrically and separately formed on a joint surface of the first-half casing and the second-half casing, and the recess includes a bevel, and the recess forms the second sliding groove after the first-half casing and the second-half casing are combined.

6. The actuator assembly for a locking device according to claim 5, wherein the two bevels of the second sliding groove have an included angle of 35 degrees to 45 degrees.

7. The actuator assembly for a locking device according to claim 1, wherein the bearing shell is in a ring shape, and the pin includes two pin nails configured head to head with each other, and each pin nail has a head with a diameter greater than the head of the inner hole of the bearing shell.

* * * * *